US007695378B2

(12) United States Patent
Nakano

(10) Patent No.: US 7,695,378 B2
(45) Date of Patent: Apr. 13, 2010

(54) GOLF CLUB HEAD

(75) Inventor: Takashi Nakano, Kobe (JP)

(73) Assignee: SRI Sports Limited, Kobe (JP)

( * ) Notice: Subject to any disclaimer, the term of this patent is extended or adjusted under 35 U.S.C. 154(b) by 70 days.

(21) Appl. No.: 11/543,908

(22) Filed: Oct. 6, 2006

(65) Prior Publication Data

US 2007/0117650 A1 May 24, 2007

(30) Foreign Application Priority Data

Nov. 22, 2005 (JP) ..... 2005-337467

(51) Int. Cl.
*A63B 53/04* (2006.01)

(52) U.S. Cl. ..... 473/345; 473/348

(58) Field of Classification Search ..... 473/324–350
See application file for complete search history.

(56) References Cited

U.S. PATENT DOCUMENTS 6,575,845 B2 * 6/2003 Smith et al. ..... 473/329
2005/0026723 A1 2/2005 Kumamoto

FOREIGN PATENT DOCUMENTS

JP 2003-199848 A 7/2003
JP 2003230643 A * 8/2003

* cited by examiner

*Primary Examiner*—Alvin A Hunter
(74) *Attorney, Agent, or Firm*—Birch, Stewart, Kolasch & Birch, LLP

(57) ABSTRACT

A hollow golf club head comprises a main body made of a metal material and being provided with at least one opening, and a cover member made of a fiber reinforced resin and attached to the main body so as to close the opening, wherein the cover member comprises an outline including a wavy part extending in a waveform.

8 Claims, 11 Drawing Sheets

GOLF CLUB HEAD

BACKGROUND OF THE INVENTION

1. Field of the Invention

The present invention relates to a hollow golf club head which comprises a head main body made of a metal material and a cover member made of a fiber reinforced resin, and more particularly to a golf club head which can improve a freedom of designing its center of gravity while increasing a joint strength between both the members.

2. Description of the Related Art

Conventionally, there has been proposed a composite type golf club head which comprises a head main body made of a metal material and provided with an opening in a crown portion, and a cover member made of fiber reinforce resin and closing the opening by being firmly attached to the head main body. In the club head mentioned above, a weight saving is achieved by the fiber reinforced resin having a small specific gravity. A weight margin obtained thereby is used, for example, for increasing a head volume and/or adjusting its center of gravity point.

In the composite type club head as mentioned above, in order to sufficiently increase a joint strength between the cover member and the head main body, for example, there can be considered a structure in which the head main body is provided with a wide supporting portion around the opening on which an inner surface of a periphery of the cover member is overlapped. However, in this method, it is hard to obtain a great weight margin.

SUMMARY OF THE INVENTION

A main object of the present invention is to provide a golf club head which can improve a freedom of designing its center of gravity while increasing a joint strength between a cover member and a head main body.

According to the present invention, a hollow golf club head comprises a main body made of a metal material and being provided with at least one opening, and a cover member made of a fiber reinforced resin and attached to the main body so as to close the opening, wherein the cover member comprises an outline including a wavy part extending in a waveform.

DESCRIPTION OF THE PREFERRED EMBODIMENTS

Figure 1:
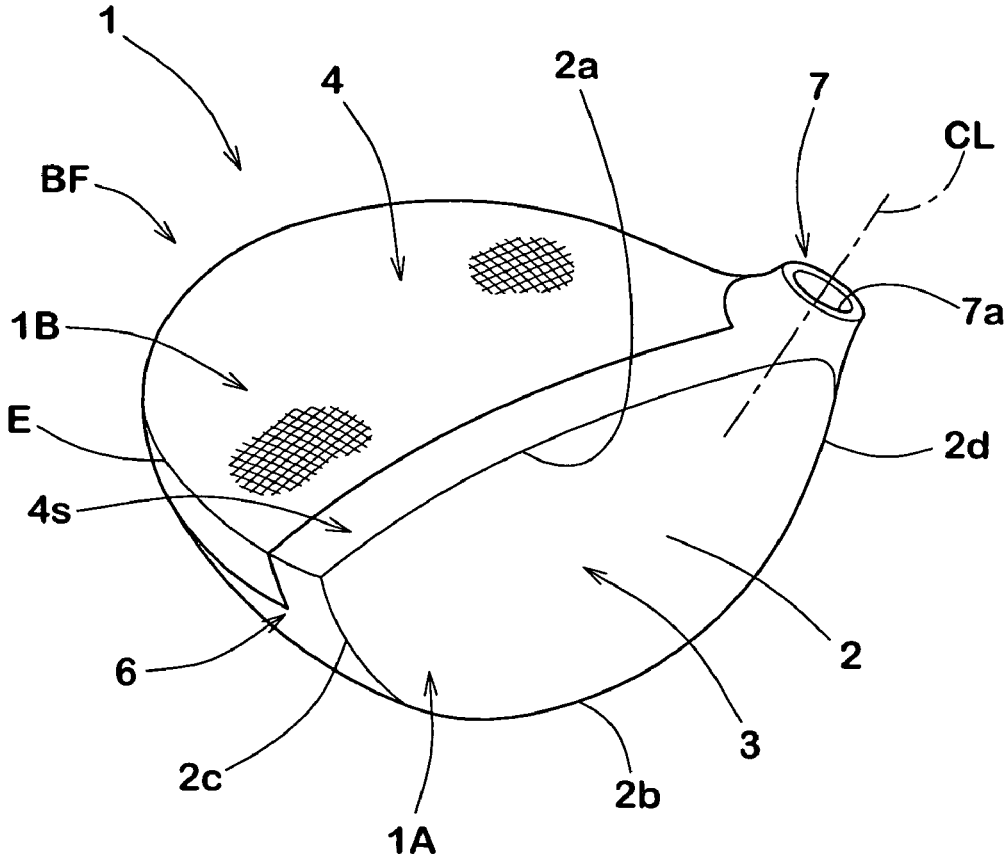
FIG. 1 is a perspective view of a standard condition of a club head showing an embodiment in accordance with the present invention.

Embodiments of the present invention will now be described in detail in conjunction with the accompanying drawings.

In the drawings, the club head 1 according to the present invention is a hollow wood-type club head such as #1 driver and fairway wood having a cavity i therein.

The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and the sole portion 5 which extends from a toe-side edge 2*c* to a heel-side edge 2*d* of the club face 2 through the back face of the club head; and a hosel portion 7 to be attached to an end of a club shaft (not shown).

FIGS. 1 to 4 show a standard condition in which a golf club head 1 according to the present embodiment. The standard condition is such that the club head 1 is set on a horizontal plane HP so that the center line CL of the club shaft (or a shaft inserting hole 7*a* of the hosel portion 7) is inclined at its lie angle within a vertical plane VP1, and the club face 2 forms its loft angle $\alpha$ (shown in FIG. 4) with respect to the horizontal plane HP.

It is desirable that the club head 1 has a volume preferably not less than 300 $cm^3$, more preferably not less than 350 $cm^3$, and further preferably not less than 370 $cm^3$. Accordingly, a moment of inertia and a depth of center of gravity of the club head 1 become large, it is possible to restrict a deflection of the club head at a time of miss shot to the minimum, and a directionality of the hit ball is improved. Further, it is possible to obtain an euphonious ball hitting sound. On the other hand, if the volume of the club head 1 is too large, a total weight of the head is increased, so that a deterioration of a swing balance and a reduction of the durability tend to be caused, for example. Accordingly, the volume of the club head is preferably not more than 600 $cm^3$, more preferably not more than 570 $cm^3$, and further preferably not more than 550 $cm^3$. In this case, since the volume of the head mentioned above is in a preferable range, it does not limit the present invention at all.

Further, if the total weight of the club head 1 is too small, the weight of the head is hard to be felt during the swing, and there is a tendency that it is hard to align a timing, and a ball carry becomes small due to a reduction of a repulsion performance. On the contrary, if the total weight of the club head 1 becomes too large, the club can not be fully swung, so that the carry and a directional stability tend to be lowered. From this point of view, the total weight of the club head 1 is preferably not less than 170 g, and more preferably not less than 180 g, and an upper limit thereof is preferably not more than 250 g, and more preferably not more than 240 g.

Figure 5:
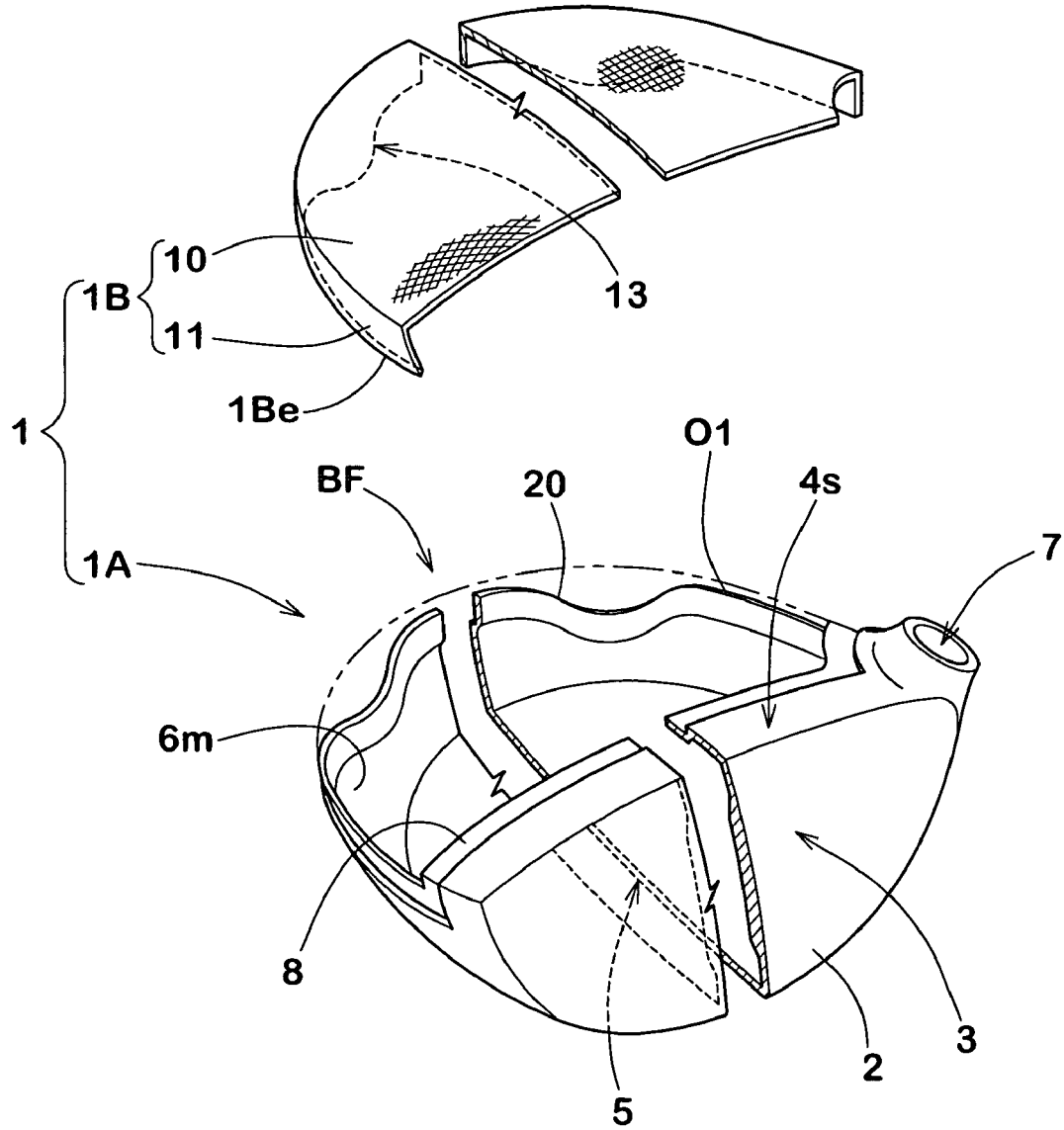
FIG. 5 is an exploded perspective view of the club head in FIG. 1 before being assembled.
Figure 6:
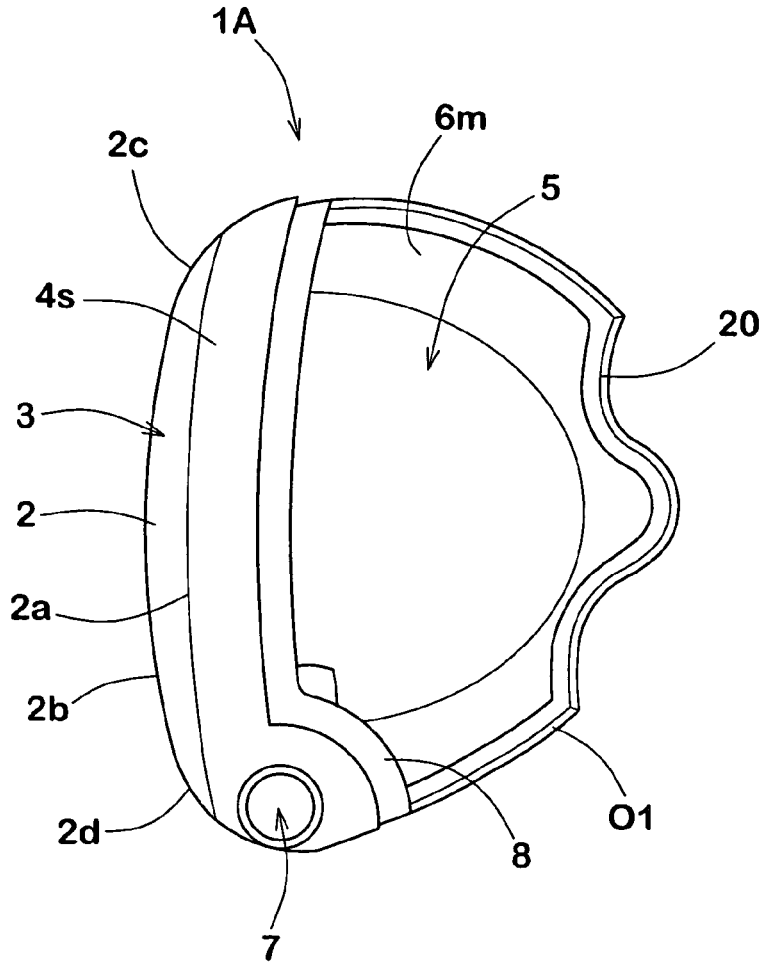
FIG. 6 is a plan view of a head main body.
Figure 7:
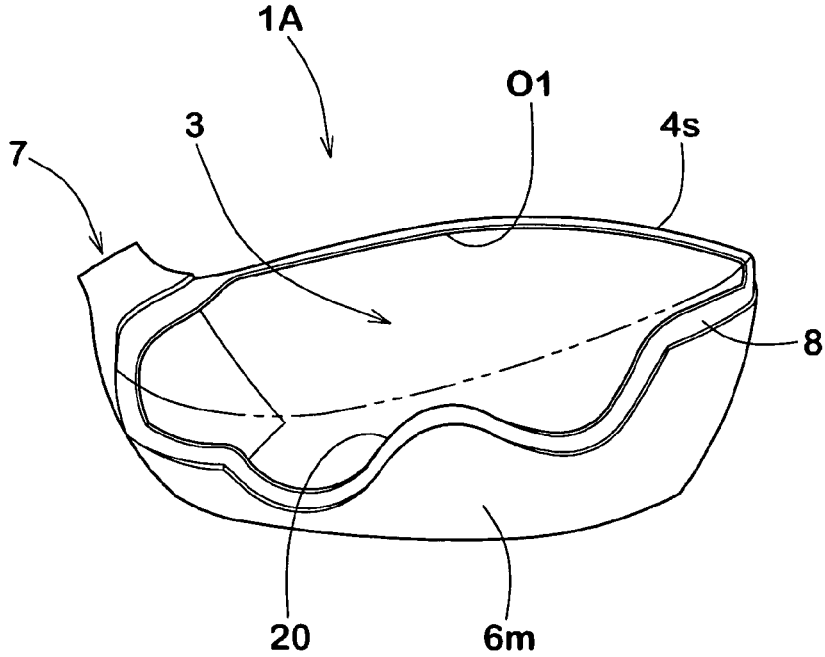
FIG. 7 is a back elevational view of FIG. 6.

FIG. 5 shows an exploded view before assembling the club head 1. The club head 1 according to the present embodiment comprises two parts comprising a head main body 1A and a cover member 1B.

In the present embodiment, the head main body 1A includes: an upper opening O1 provided so as to include at least a part of the crown portion 4; a crown front portion 4*s* provided between the upper opening O1 and the club face 2; the face portion 3; the sole portion 5; a side main portion 6*m* which comprises a main portion of the side portion 6; and the hosel portion 7.

The head main body 1A is made of a metal material, and is formed by a cast product (more particularly, a lost wax precision cast product) in which respective portions are previously formed integrally. Accordingly, a productivity of the club head 1 is improved. However, the head main body 1A may be formed by forging or bending a rolled steel material, or may be formed by bonding two or more members.

The metal material forming the head main body 1A is not particularly limited, however, preferably employs a titanium, a titanium alloy, an aluminum alloy, a maraging steel, a stainless steel, a magnesium alloy or the like, in the light of a durability and an external injury resistance. It is desirable that a specific gravity of the material preferable for the head main body 1A is preferably not less than 3.0, and more preferably not less than 4.0. On the other hand, if the specific gravity is too large, there is a risk that the head weight is increased. Accordingly, the specific gravity of the club head is preferably not more than 8.0, more preferably not more than 7.0, and further preferably not more than 5.0.

It is preferable that the upper opening O1 includes at least a part of the crown portion 4, more preferably the upper opening O1 includes the main portion of the crown portion 4. In order to obtain a sufficient weight margin, a ratio (So/Sa) between a total surface area (measured in a state in which a shaft insertion hole 7*a* of the hosel portion 7 is filled) "Sa" of the club head 1, and an opening area "So" obtained by projecting the upper opening O1 on an outer surface of the head is preferably set not less than 0.20, more preferably not less than 0.30, and further preferably not less than 0.35. However, if the ratio (So/Sa) is too large, the durability of the club head 1 tends to reduce. Accordingly, it is desirable that the upper limit of the ratio (So/Sa) is preferably not more than 0.50, and more preferably not more than 0.45.

Further, the upper opening O1 may be structured such as to extend to the side portion 6 from the crown portion 4. However, for securing the durability of the club head 1, the upper opening O1 is preferably provided without extending to the face portion 3.

The upper opening O1 according to the present embodiment includes a main portion of the crown portion, and a part of an upper portion of the side portion 6. Further, since a great stress is applied to the portion close to the club face in the crown portion 4 at a time of hitting the ball, the upper opening O1 is preferably provided close to the back face BF. Therefore, such a structure makes it possible to improve the durability of the head 1 by forming the crown front portion 4*s* by a metal material having a large strength.

Further, a supporting portion 8 with a small width is provided around the upper opening O1 continuously. The supporting portion 8 is concaved in a step shape from a finished surface of the club head 1 to the hollow portion "i" so as to receive an inner surface of a periphery of the cover member 1B thereon. Accordingly, an entire region of the upper opening O1 is closed by the cover member 1B. Therefore, the outer surface of the cover member may become flush with the finished surface of the main body 1A by optimizing a step amount of the supporting portion 8 in correspondence to the thickness of the cover member 1B. This serves for simplifying a finishing process.

A width RW of the supporting portion 8 is not particularly limited, however, if the width is too large, it is hard to obtain a great weight margin from an upper portion of the club head 1. On the contrary, if the width of the supporting portion 8 is too small, a joint area with the cover member 1B becomes small. Accordingly, the durability of the club head 1 tends to be lowered. From this point of view, the width RW of the supporting portion 8 is preferably not less than 3 mm, and more preferably not less than 5 mm, and an upper limit thereof is preferably not more than 15 mm, and more preferably not more than 10 mm.

The cover member 1B is made of a fiber reinforced resin, and integrally includes a base portion 10 which covers the upper opening O1 in the crown portion 4, and an subsidiary portion 11 which extend from the base portion 10 so as to cover the opening O1 in the side portion 6, in the present embodiment. Therefore, the subsidiary portion 11 forms a part of the side portion 6.

Since the cover member 1B made of the fiber reinforced resin has a very small specific gravity compared with the metal material, the weight of the crown portion 4 is widely reduced, and it is possible to obtain a great weight margin for enlarging a head volume and/or adjusting a center of gravity of the head. Accordingly, a freedom of designing the center of gravity is improved. Further, a weight saving of the crown portion 4 provides a center of gravity of the club head 1 to a low position. Such a club head mentioned above can obtain a ball trajectory optimum for increasing the carry having a high ball hitting angle and a low backspin. From this point of view, it is desirable that the specific gravity of the fiber reinforced resin is preferably not more than 3.0, and further preferably not more than 2.0. Further, a lower limit of the specific gravity is preferably not less than 1.0, owing to a material supplying characteristic.

The fiber reinforced resin is structured by combining optionally selected a reinforced fiber and a matrix resin. In the present embodiment, a CFRP obtained by combining an epoxy resin and a carbon fiber is used. This is preferable in a point having characteristics such as a high strength, an excellent molding performance, a low cost and a low specific gravity (specific gravity not more than 1.7).

The reinforced fiber can employ, for example, one or two or more of a carbon fiber, a glass fiber, an aramid fiber, a boron fiber, an aromatic polyamide fiber, an aromatic polyester fiber, an ultra high polymer polyethylene fiber, a polyphenylene benzoxazole resin fiber (a PBO fiber), an amorphous fiber, a titanium fiber and the like.

As the matrix resin, for example, a thermosetting resin, a thermoplastic resin or the like is used, however, the thermosetting resin, especially an epoxy resin is preferable used in the light of the strength and the rigidity. As the thermosetting resin, for example, the epoxy resin, an unsaturated polyester resin, a phenol resin, a melamine resin, a urea resin, a diallyl phthalate resin, a polyurethane resin, a polyimide resin, a silicon resin or the like is used. Further, as the thermoplastic resin, for example, a polyamide resin, a saturated polyester resin, a polycarbonate resin, an ABS resin, a polyvinyl chloride resin, a polyacetal resin, a polystyrene resin, a polyethylene resin, a poly vinyl acetate resin, an AS resin, a methacrylic resin, a polypropylene resin, a fluorine contained resin or the like is used.

The cover member 1B may be bonded on the supporting portion 8 of the head main body 1A, for example, by using an adhesive agent or the like after being previously formed in a predetermined shape, or may be adhered to the supporting portion 8 while being formed in a predetermined shape by applying heat and pressure thereto, after attaching at least one uncured prepreg ply (not shown) onto the supporting portion 8 so as to cover the opening O1.

Figure 3:
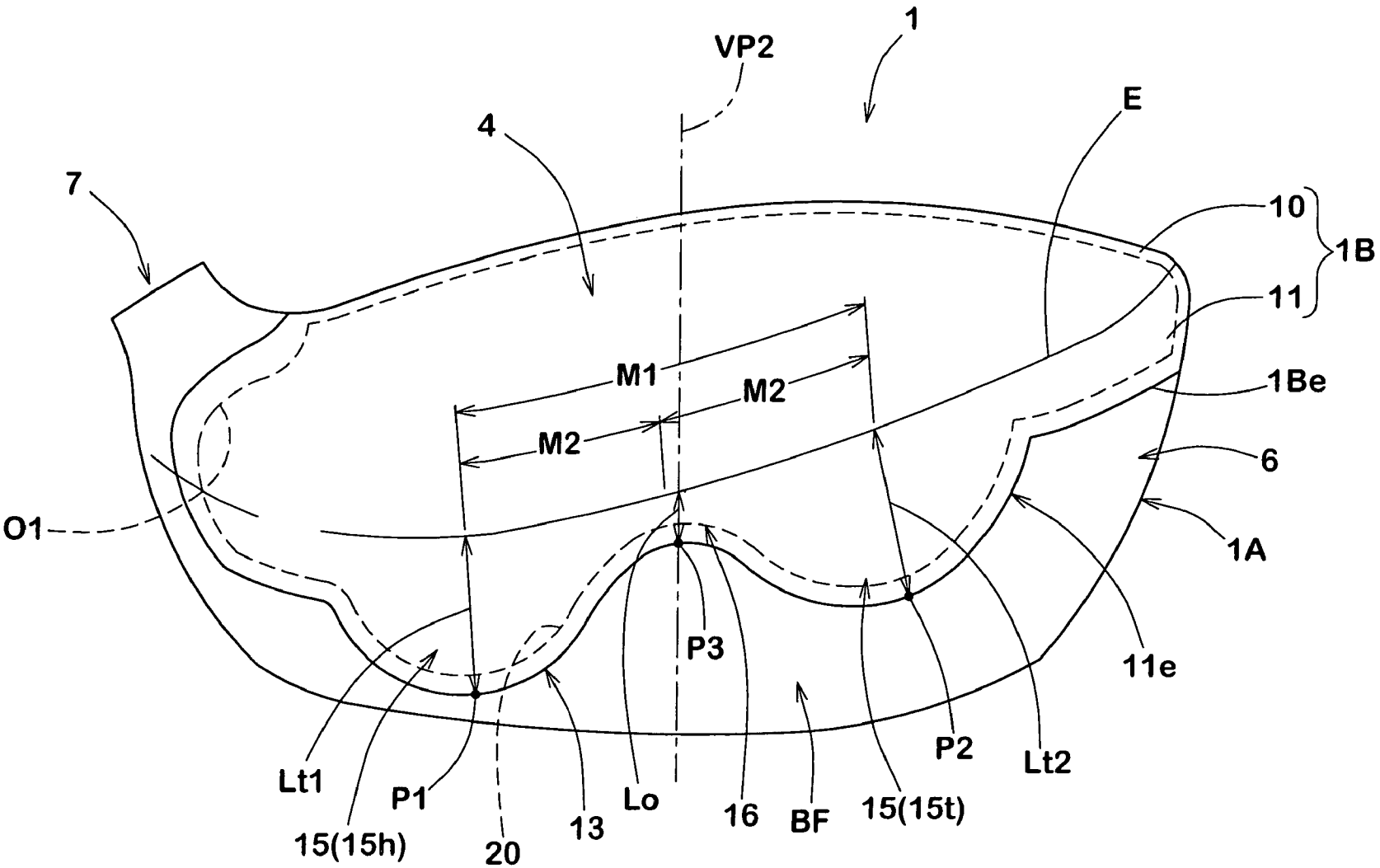
FIG. 3 is a back elevational view as seen from a back face side of the club head in FIG. 1.
Figure 4:
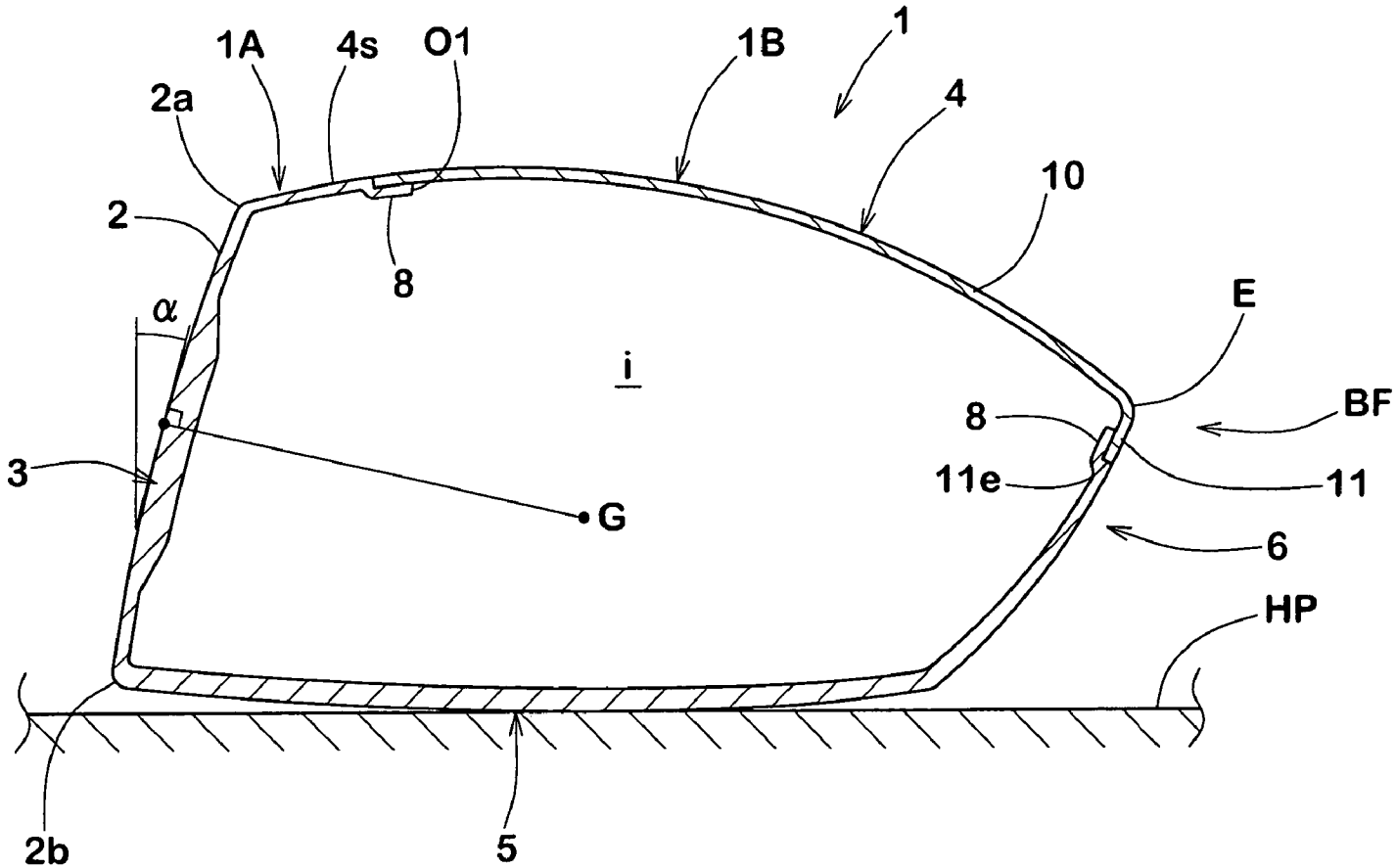
FIG. 4 is a cross sectional view along a line X-X in FIG. 2.

Further, as shown in FIGS. 3 and 5, the cover member 1B comprises an outline 1Be which includes a wavy part 13 extending in a waveform. The description "extending in a waveform" means extending while the outline 1Be repeats a periodical oscillation. It is not necessary that an amplitude and a cycle of the wave are fixed. Further, the concrete shape of the wave is not particularly limited, but includes various shapes, for example, a sine waveform, a rectangular waveform, a trapezoidal waveform, a zigzag shape and the like. In this case, if the corner of the wave becomes sharp, a damage such as clacks tends to be generated in the corner. Accordingly, it is desirable that the wavy part 13 is preferably formed in a smoothly extending sine waveform.

The wave part 13 according to the present embodiment is included in the subsidiary portion 11 of the cover member 1B. Accordingly, the wavy part 13 extends within the side portion 6.

Further, the support portion 8 include a wavy inner-edge part 20 extending in a waveform around the upper opening O1. A phase of the wavy inner-edge 20 of the support portion 8 is synchronized with a phase of the wavy part 13 of the cover member 1B, as shown in FIG. 3. Accordingly, a width of the supporting portion 8 including the wavy inner-edge part 20 is formed substantially constant in the present embodiment, and is provided around the opening O1 continuously.

Figure 12:
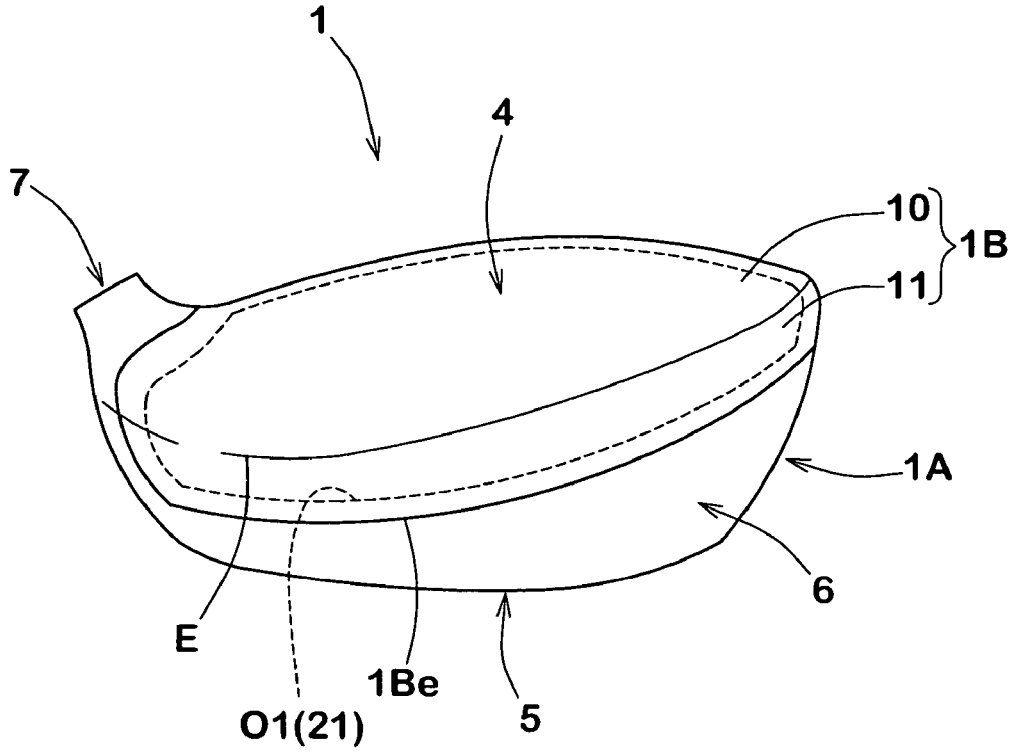
FIG. 12 is a back elevational view of a club head according to a reference.

Since the wavy part 13 increases the length of the outline 1Be of the cover member 1B, the club head 1 as mentioned above increases a joint area between the head main body 1A and the cover member 1B, and as a result, it is possible to improve a joint strength of both the members 1A and 1B. As shown in FIG. 12, if the outline 1Be of the subsidiary portion 11 extends along a boundary E between the crown portion 4 and side portion 6, the rigidity of the side portion 6 is rapidly changed at the certain height which corresponds to the outline 1Be (or the inner-edge 21 of the opening O1, and so on). Accordingly, the stress tends to be concentrated to the outline 1Be of the cover member 1B at a time of hitting the ball. On the contrary, the wavy part 13 can relax the rapid rigidity change at the certain height of the side portion 6 as mentioned above. Therefore, it is possible to prevent the stress concentration to the outline 1Be, and to protect the cover member 1B. Further, since the stress can be relaxed in the joint portion between the cover member 1B and the head main body 1A, the joint strength is improved.

In order to effectively achieve the effect mentioned above, it is desirable that the wavy part 13 has a length which is preferably not less than 1 cycle, and more preferably not less than about 1.5 cycle as in the present embodiment.

Figure 2:
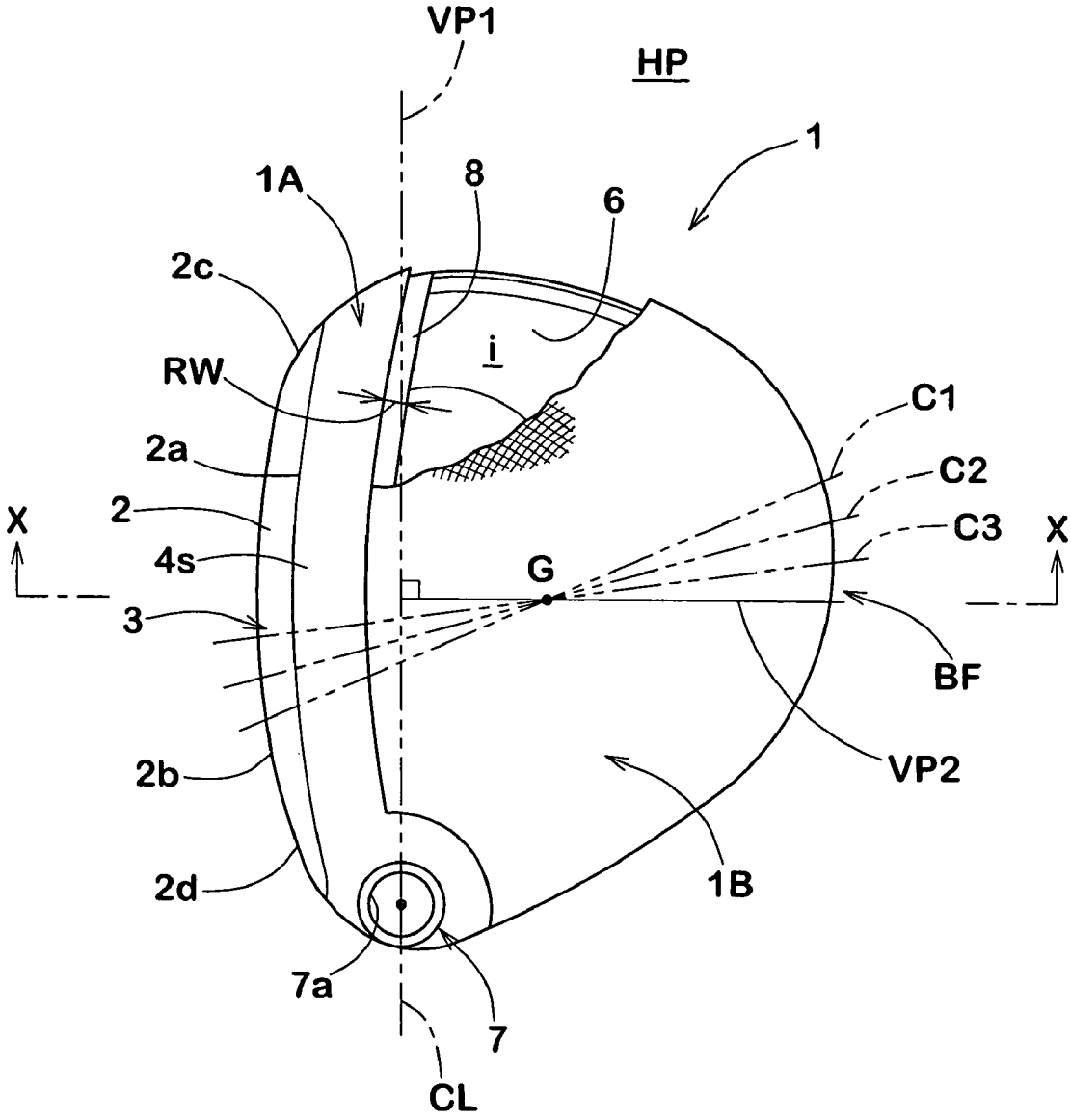
FIG. 2 is a plan view of the club head in FIG. 1.
Figure 8:
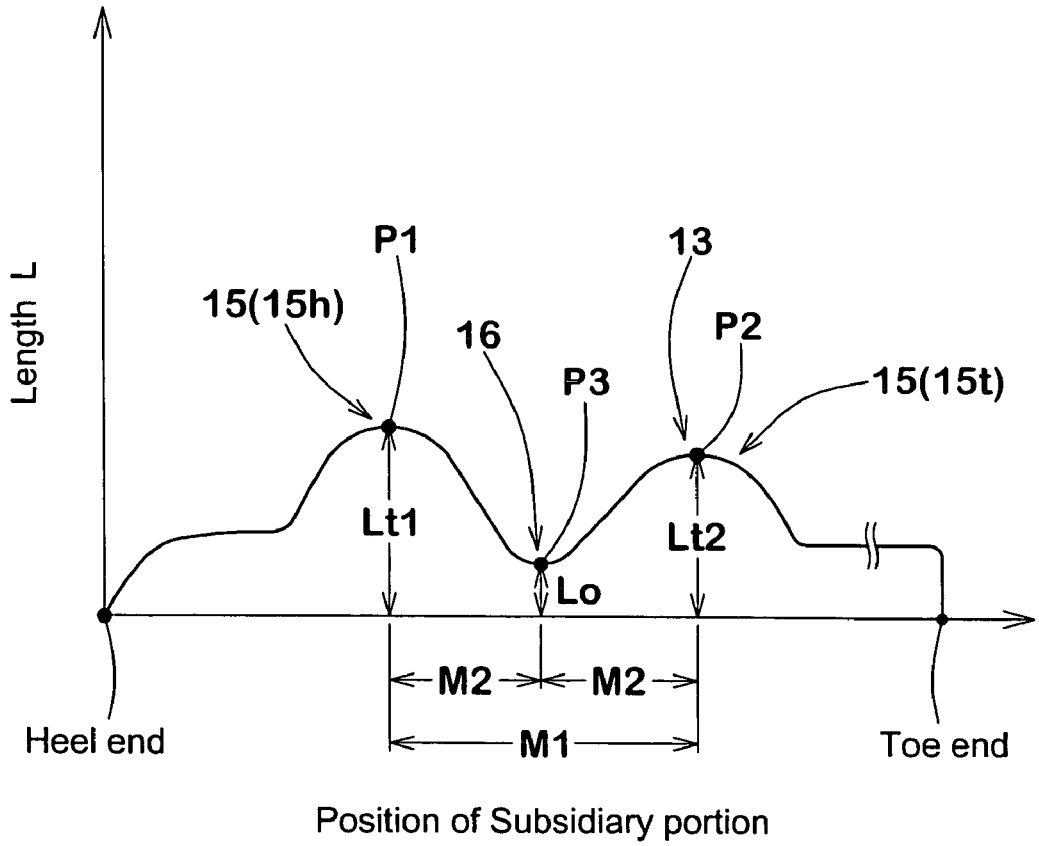
FIG. 8 is a graph showing a relation between a length from a boundary to a wavy part of a cover member.
Figure 9:
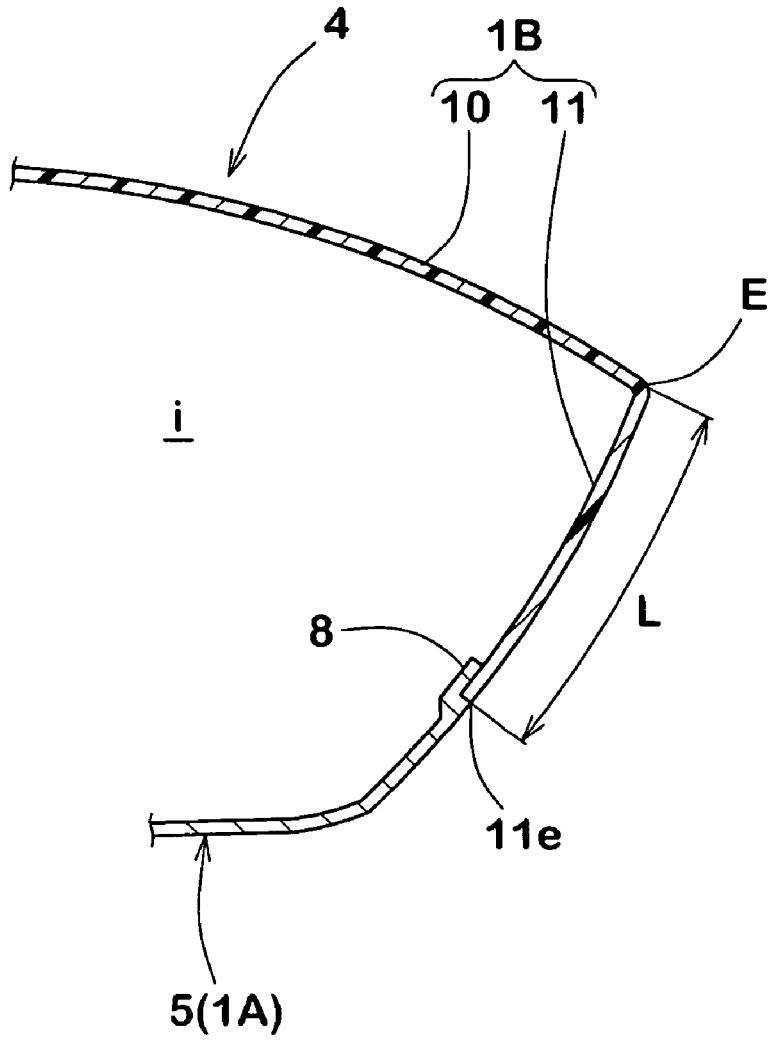
FIG. 9 is a partly cross sectional view of a position C1 in FIG. 2.

FIG. 8 shows a graph in which a horizontal axis is set as a position of the subsidiary portion and a vertical axis is set as a length L from the boundary E to the outline 1Be of the subsidiary portion 11 at the position mentioned above. The length L corresponds to a length from the boundary E in the cross section of the club head 1 cut by each of the vertical surfaces C1, C2, C3, . . . passing through the gravity point G of the club head 1 in the standard condition and intersecting the side portion, as shown in FIG. 2 to the outline 1Be of the subsidiary portion 11 along the surface of the side portion 6, as shown in FIG. 9. In this case, if the boundary E can be specified by a clear edge, it is defined by the edge. However, if the edge is unclear, it is determined by connecting points at which a radius of curvature becomes smallest in a boundary portion between the side portion 6 and the crown portion 4, in a border line of each of head cross sections cut by a plurality of the vertical surfaces C1, C2, C3.

AS is apparent from FIGS. 3 and 8, the wavy part 13 comprises at least two convex parts 15 with lower peaks P1 and P2 smoothly protruding toward the sole portion 5, and a concave part 16 with an upper peak P3 provided between the convex parts 15 and smoothly concaved toward the boundary E. The Length L of the subsidiary portion 11 becomes the largest at the position of the lower peaks P1 and P2, but becomes smallest at the position of the upper peak P3.

According to a preferable embodiment, these two convex portions 15 include a toe-side convex portion 15*t* and a heel-side convex portion 15*h* in which the respective peaks P1 and P2 are positioned in both sides of a vertical plane VP2 being parallel to a front-rear direction passing through the center of gravity G of the head. Here, the front-rear direction" shall be a direction being perpendicular to the vertical plane VP1 mentioned above, in the standard condition. Accordingly, an impact force applied to the cover member 1B at a time of hitting the ball is dispersed to the toe and heel directions respectively along the toe side convex portion 15*t* and the heel side convex portion 15*h* in the subsidiary portion 11. As a result, the stress applied to the cover member 1B becomes smaller, and the durability is increased. Further, since the strain of the cover member 1B becomes smaller, an energy loss in the crown portion 4 is reduced, and accordingly, a repulsion performance of the club head 1 is improved. Further, since the impact force is widely dispersed to the cover member 1B so as to be absorbed, an impact transmitted to the hand of the golfer becomes smaller, and a ball hitting feeling is improved.

Further, it is desirable that a ratio (Lo/Lt) between an average Length "Lt" of lengths "Lt1" and "Lt2" of the subsidiary portion 11 at the positions of the lower peaks P1 and P2, and a length "Lo" of the subsidiary portion 11 at the upper peak P3, is preferably not less than 0.25, and more preferably not less than 0.30, in these two convex portions 15*t* and 15*h*, and it is desirable that the upper limit is less than 1.0, preferably not more than 0.80, more preferably not more than 0.70, and further preferably not more than 0.50. In the case that the ratio (Lo/Lt) is less than 0.25, a bending change of the wavy part 13 becomes sharp, and accordingly, a damage tends to be generated near the peak of the convex portion 15 or the concave portion 16. On the contrary, if the ratio (Lo/Lt) gets over 0.8, the effect of relaxing the impact force and the stress becomes small.

The lengths Lt1 and Lt2 of the respective convex portions 15 are appropriately defined in correspondence to the height of the side portion 6 of the club head 1 or the like. However, if it is too small, it is hard to obtain a sufficient effect of relaxing the stress or the like. On the contrary, if it is too large, the convex portions come close to the edge of the sole portion 5, and tend to be brought into contact with the ground surface at a time of swinging. From this point of view, it is desirable that the lengths Lt1 and Lt2 is preferably not less than 10 mm, more preferably not less than 20 mm, and further preferably not less than 25 mm, and it is desirable that the upper limit is preferably not more than 40 mm, more preferably not more than 35 mm, and further preferably not more than 30 mm.

Further, the length Lo of the concave portion 16 is defined by the length of the convex portion 15 and the ratio (Lo/Lt), however, it is desirable that the length Lo is preferably not less than 3 mm, more preferably not less than 5 mm, and further preferably not less than 10 mm, and an upper limit thereof is preferably not more than 30 mm, more preferably not more than 20 mm, and further preferably not more than 15 mm.

Further, it is desirable that a distance M1 along the boundary E between the peak P1 of the toe-side convex portion 15*t* and the peak P2 of the heel-side convex portion 15*h* is preferably not less than 20 mm, more preferably not less than 30 mm, and further preferably not less than 40 mm, and an upper limit thereof is preferably not more than 60 mm, more preferably not more than 55 mm, and further preferably not more than 50 mm. If the distance M1 is too small, a stress concentration tends to be generated in the concave portion 16. On the contrary, if the distance M1 is too large, the convex portion 15 comes close to the toe side edge 2*c* and the heel side edge 2*d* of the face 2, and is exposed to a great impact force at a time of hitting the ball.

Further, it is desirable that a distance M2 along the boundary E from the peak P3 of the concave portion 16 to the respective peaks P1 and P2 of the convex portions 15*t* and 15*h* is preferably not less than 10 mm, more preferably not less than 15 mm, and further preferably not less than 20 mm, from the same point of view, and it is desirable that the upper limit is preferably not more than 30 mm, more preferably not more than 28 mm, and further preferably not more than 25 mm.

Further, it is desirable that the wavy part 13 is provided at a position which does not intersect the boundary E. Since the stress tends to be concentrated to the boundary E, if the wavy part 13 intersects the portion, there is a tendency that the durability of the club head 1 is lowered on the contrary. Further, it is hard to bond the head main body, and the productivity tends to be lowered.

Figure 10A:
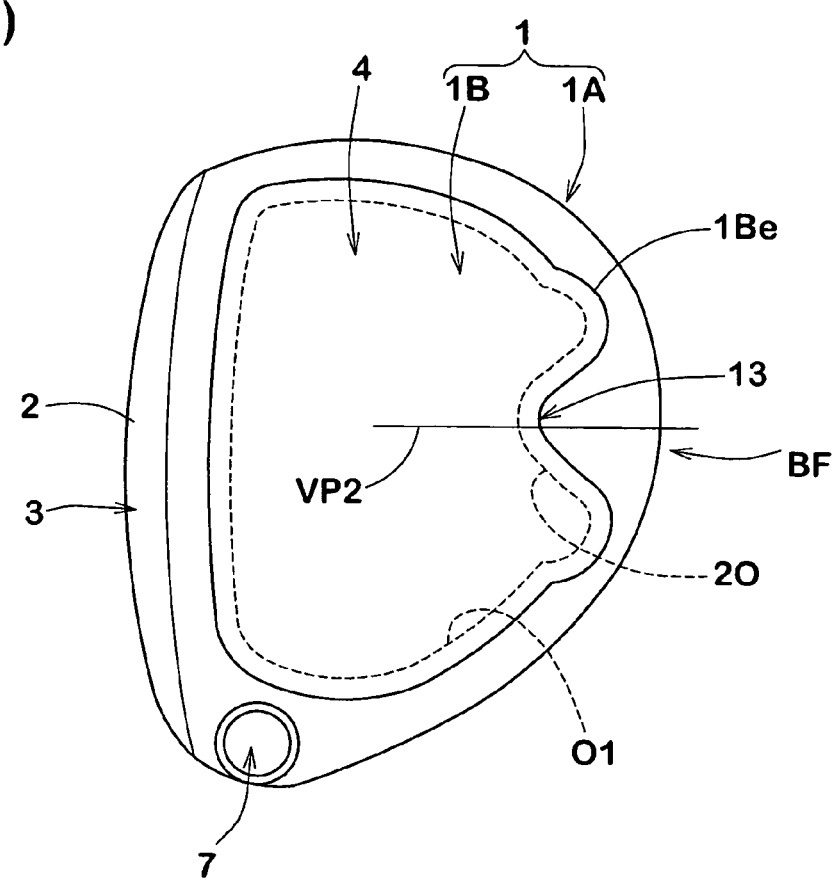
FIGS. 10(A) and 10(B) each are plan views of a club head showing the other embodiment according to the present invention.
Figure 10B:
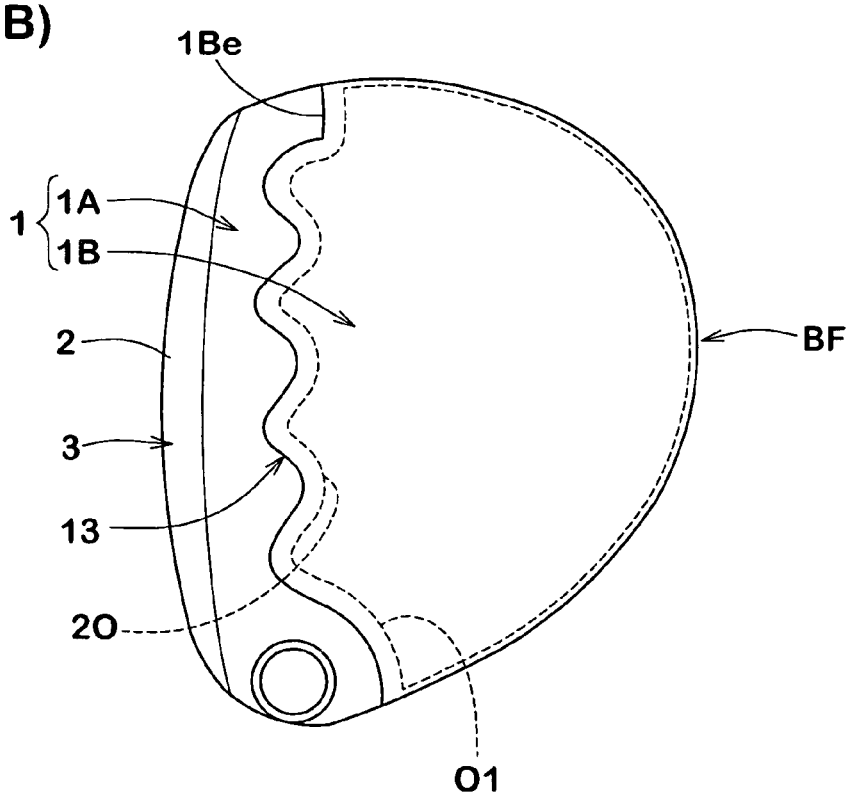
Figure 11A:
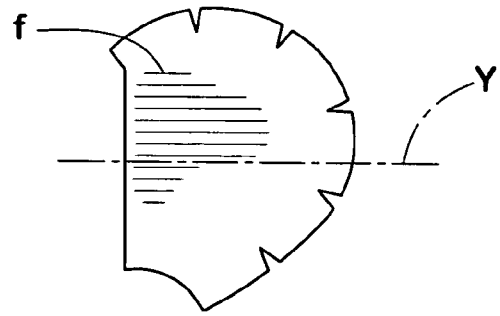
FIG. 11 is an expansion plan view of a prepreg constituting a cover member.
Figure 11B:
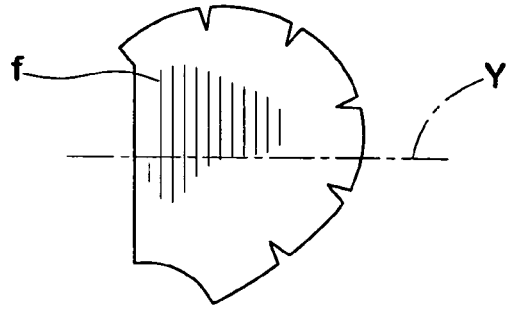
Figure 11C:
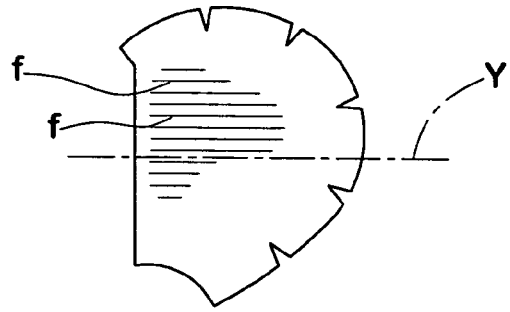
Figure 11D:
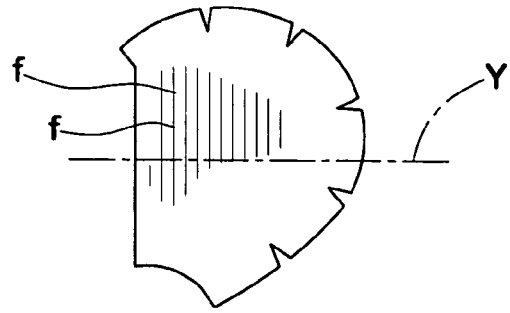

The description is given above of the embodiment according to the present invention, however, this invention is not limited to the embodiment mentioned above, but can be carried out by being modified to various aspects. For example, as shown in FIG. 10(A), the cover member 1B may be structured such as to be accommodated, for example, in the crown portion 4 and include no subsidiary portion 11 mentioned above. Further, as shown in FIG. 10(B), the wavy part 13 may be provided in the front side in place of the subsidiary portion 11.

Comparison Test:

Next, a description will be given of a preferable embodiment according to the present invention.

A wood type club head having a head volume of 450 $cm^3$ is manufactured on the basis of the specification in FIG. 1 and Table 1 (example). A cast product of Ti-6Al-4V is employed for the head main body, a carbon fiber reinforced resin (CFRP) is employed for the cover member, respectively.

The cover member is manufactured as a structure having a main portion and an subsidiary portion in which a wavy part having a predetermined shape is formed, by alternately laminating a plurality of, four prepreg plies in which a reinforced fiber f is oriented in each of a front-rear direction Y of the head and a toe-heel direction orthogonal thereto, and heating and pressurizing it by a press molding so as to mold and harden the wavy part, as shown in FIG. 11. Further, the club head is manufactured by bonding the cover member and the head main body by an adhesive agent.

Further, as shown in FIG. 12, there is also manufactured by way of trial a club head formed by bonding a cover member having no wavy part in the auxiliary portion, and the head main body (a reference). An area of the opening of the club head is set to be identical to the example 1.

Further, a carry performance, a durability and a ball hitting feeling are measured about each of the club heads. The test method is as follows.

Carry Performance:

45 inch wood type golf clubs were manufactured by way of trial by installing the same shaft of FRP to each of the trial heads, and the test clubs were attached to a swing robot, five golf balls were hit by each of the clubs after adjusting a head speed to 45 m/s, and a carry (carry+run) of the hit ball was measured and evaluated on the basis of an average value of the carry.

Durability:

The golf balls were repeatedly hit at a head speed of 50 m/s at a center point of the club face, by using the swing robot, and the number of the balls was measured until a damage was generated in a joint portion between the head main body and the cover member. In this case, the maximum ball hitting number was set to 3000.

Ball Hitting Feeling:

Each of thirty golfers hit five golf balls by way of trial, and a number of the golfers feeling "good (soft) hitting feeling" was evaluated on the basis of the following standard.

Very good: number of golfers feeling good is not less than 25

Good: number of golfers feeling good is not less than 20 and less than 25

Common: number of golfers feeling good is not less than 15 and less than 20

Bad: number of golfers feeling good is less than 15

Results of the tests and the like are shown in Table 1.

As a result of the tests, it is confirmed that the durability and the ball hitting feeling are improved. Further, it is confirmed that the excellent performance can be achieved in the carry performance.

TABLE 1

| | | Ref. | Ex. 1 | Ex. 2 | Ex. 3 | Ex. 4 | Ex. 5 | Ex. 6 |
|---|---|---|---|---|---|---|---|---|
| | Head shape view | FIG. 12 | | | FIG. 3 | | | |
| | With or without wavy part of cover member | Without | | | With | | | |
| | Length of convex portion Lt [mm] | 30 | 40 | 40 | 33 | 30 | 30 | 25 |
| | Length of concave portion Lo [mm] | 30 | 8 | 10 | 10 | 15 | 20 | 20 |
| | Ratio (Lo/Lt) | 1.0 | 0.20 | 0.25 | 0.30 | 0.50 | 0.67 | 0.80 |
| | Distance M1 [mm] | — | 30 | 30 | 30 | 30 | 30 | 30 |
| | Distance M2 [mm] | — | 15 | 15 | 15 | 15 | 15 | 15 |
| | Ratio (So/Sa) | 0.40 | 0.40 | 0.40 | 0.40 | 0.40 | 0.40 | 0.40 |
| Test results | Carry performance [yard] | 260<br>3000 | 265<br>2800 | 275<br>3000 | 285<br>3000 | 280<br>3000 | 280<br>3000 | 270<br>3000 |
| | Durability | Bad | Common | Good | Very good | Very good | Very good | Good |
| | Ball hitting feeling | | | | | | | |

The invention claimed is:

1. A hollow golf club head comprising a face portion whose front face defines a club face for hitting a golf ball, a crown portion intersecting the club face at an upper edge thereof, a sole portion intersecting the club face at a lower edge thereof, a side portion between the crown portion and the sole portion which extends from a toe-side edge to a heel-side edge of the club face through a back face of the club head, a main body made of a metal material and having the face portion, the sole portion and at least one opening, said at least one opening being an upper opening formed in at least a part of the crown portion, and a cover member made of a fiber reinforced resin and attached to the main body so as to close the opening, wherein the cover member comprises an outline including a wavy part extending in a cyclical waveform having a periodic oscillation, and the wavy part has a length that includes not less than 1.5 cycles of the waveform, the main body has a support portion being provided around the opening for supporting an inner surface of a periphery of the cover member, and the edge of the opening comprises an outline including a wavy edge part extending in a cyclical waveform having a periodic oscillation, and the wavy edge part has a length that includes not less than 1.5 cycles of the waveform, wherein the phases of the wavy part of the cover member are substantially synchronized with the phases of the wavy edge part of the opening so that a width of the support portion is substantially constant at all regions of the wavy part of the opening.

2. A hollow golf club head having a face portion comprising a front face that defines a club face for hitting a golf ball, a crown portion intersecting the club face at the upper edge thereof, a sole portion intersecting the club face at the lower edge thereof and a side portion between the crown portion and the sole portion which extends from a toe-side edge to a heel-side edge of the club face through a back face of the head, the head comprising:

a main body made of a metal material and being provided with at least one opening extending from the crown portion to the side portion, a cover member made of a fiber reinforced resin and attached to the main body so as to close the opening, the cover member comprising a base portion covering the opening in the crown portion, a subsidiary portion extending from the base portion so as to cover the opening in the side portion and a boundary between the base portion and the subsidiary portion, wherein a wavy part extending in a waveform is provided on the outline of the subsidiary portion so as to extend in the side portion, and wherein the wavy part comprises a pair of lower peaks being close to the sole portion and an upper peak between the lower peaks being close to the crown portion, and a ratio (Lo/Lt) is not less than 0.25 and less than 1.0, wherein "Lo" is a length of subsidiary portion from the boundary to the outline of the subsidiary portion at the position of the upper peak and "Lt" is an average length of the subsidiary portion at the positions of lower peaks.

3. The golf club head according to claim 2, wherein a support portion is provided around the opening for supporting an inner surface of a periphery of the cover member, and the edge of the opening includes a wavy edge part extending in a waveform.

4. The golf club head according to claim 3, wherein a phase of the wavy part of the cover member is substantially synchronized with a phase of the wavy part of the opening.

5. The golf club head according to claim 2, wherein the wavy part extends on the back face of the side portion.

6. The golf club head according to claim 2, wherein said each lower peak is provided at both sides of a vertical plane being parallel to a front-rear direction through a center of gravity of the club head.

7. The golf club head according to claim 2, wherein a distance M1 along the boundary between the lower peaks is in the range of from 20 to 60 mm.

8. The golf club head according to claim 4, wherein a width of the support portion is substantially constant at all regions of the wavy part of the opening.

* * * * *